United States Patent [19]

Huber

[11] 4,340,177

[45] Jul. 20, 1982

[54] SHOWER DEVICE

[75] Inventor: Markus Huber, Österreich, Fed. Rep. of Germany

[73] Assignee: Firma Friedrich Grohe Armaturenfabrik GmbH, Fed. Rep. of Germany

[21] Appl. No.: 118,383

[22] Filed: Feb. 5, 1980

[30] Foreign Application Priority Data

Feb. 7, 1979 [AT] Austria ..... 898/79

[51] Int. Cl.[3] ..... B05B 3/16

[52] U.S. Cl. ..... 239/242

[58] Field of Search ..... 239/102, 237, 239, 240, 239/242, 381–383, 225, 255, 568; 128/47, 50

[56] References Cited

U.S. PATENT DOCUMENTS

| | | | |
|---|---|---|---|
| 996,480 | 6/1911 | Glaser | 239/240 |
| 1,764,758 | 6/1930 | Slining | 239/242 |
| 1,765,939 | 6/1930 | Roach | 239/242 |
| 1,966,573 | 7/1934 | Webb | 239/568 X |
| 2,583,175 | 1/1952 | Hautau | 239/242 X |
| 2,714,080 | 7/1955 | Kennedy et al. | 239/227 X |
| 2,769,665 | 11/1956 | Spender | 239/242 |
| 2,914,255 | 11/1959 | Jepson | 239/242 |
| 3,073,532 | 1/1963 | Rinkewich | 239/242 |
| 3,544,012 | 12/1970 | McNally | 239/227 |

*Primary Examiner*—Johnny D. Cherry
*Attorney, Agent, or Firm*—William A. Drucker

[57] ABSTRACT

A shower device in which the head which carries one or more water-nozzles oscillates around its middle axle, so that the water spray can cover a big portion of the body.

The oscillating movement is activated by the water used for the shower.

5 Claims, 5 Drawing Figures

SHOWER DEVICE

BACKGROUND OF THE INVENTION

1. Field of the Invention

The present invention relates to a shower apparatus comprising a housing, which is preferably connected to a flexible water supply, and a shower head mounted on said housing.

2. Description of the Prior Art

Shower apparatuses of the above-mentioned kind are widely used in baths and bathrooms.

It is the object of the present invention to provide a shower apparatus of this kind by means of which a full shower effect and an additional massage effect are produced at the same time without having to operate the shower head by hand.

According to the invention this is achieved by adapting the shower head to be carried by a connecting pipe which oscillates in said housing.

The oscillating movement is an incomplete rotation, preferably by an angle of between 50° and 80°, around the longitudinal center axis of the connecting pipe.

Such shower apparatuses can be attached to fixed carriers. They oscillate automatically and thereby spray broad water jets over large portions of the body. For this purpose, the shower head of one embodiment of the present invention is provided with broad-slot-type jet nozzles.

The points of impact on the body surface change rapidly and, hence, produce a particularly stimulating effect. The shower head is preferably turnable around 360° on the connecting pipe so that the direction of water jets can be turned into any desired position.

This shower apparatus can also be attached above the bath tub, and this use is particularly attractive.

While the water runs into the bath tub the oscillating shower apparatus sprays water jets from above horizontally on the person taking a bath.

The oscillating movement can be stopped by a switch lever, and the shower apparatus can be used as an ordinary hand shower.

Prior art shower apparatuses produce pulsating and bubbling water jets. Shower apparatuses, which have become known lately, comprise two shower heads which move automatically along a guide rail from the top to the bottom, said guide rail being fixedly mounted to the wall.

Self-propelled apparatuses for the massage of the body have, for example, been described in U.S. Pat. No. 1,305,358 and in U.S. Pat. No. 3,042,949.

These massage apparatuses are exclusively used for the massage of the body and only a small part of the driving water is used for washing the body. Consequently, their range of action is very limited.

SUMMARY OF THE INVENTION

The important difference between the apparatus of the present invention and the afore-mentioned apparatuses is that the apparatus of the invention is adapted to be fully used as a shower. It can be connected to any shower hose as an ordinary hand shower.

Due to its wide range of oscillation, the possibility to turn the shower head, and due to the broad jets, which leave the nozzles arranged on the shower head, the apparatus in accordance with the present invention has a very wide range of action.

The apparatus of the present invention may also comprise a shower head with a rotating nozzle resp. a rotating water jet instead of the broad-jet nozzles. It may also be combined with prior art shower heads producing bubbling or pulsating water jets.

A preferred embodiment provides that the connecting pipe is oscillated by means of an eccentric driving means.

According to the invention, the water can be used for effecting the oscillating movement by arranging a turbine wheel in the housing opposite the entrance point of the water, said turbine wheel being coupled to the eccentric driving means by means of a reducing gear.

In the embodiment, wherein the shower head is provided with broad-jet nozzles, the shower head is preferably of longitudinal configuration.

A further preferred embodiment provides that a deflecting plate is arranged between the point where the water enters into the housing and the turbine wheel for controlling the oscillating speed of the shower head, said deflecting plate being pivotable by means of a lever arranged on the outer side of the housing.

The massage effect can be improved by providing the shower head with rotating nozzles which are rotatably linked to one another by means of a reducing gear or by providing the shower head with a nozzle producing a bubbling or pulsating effect.

BRIEF DESCRIPTION OF THE DRAWING

In the following the invention will be described in more detail by means of the figures of the drawing.

DESCRIPTION OF THE PREFERRED EMBODIMENTS

Figure 1:
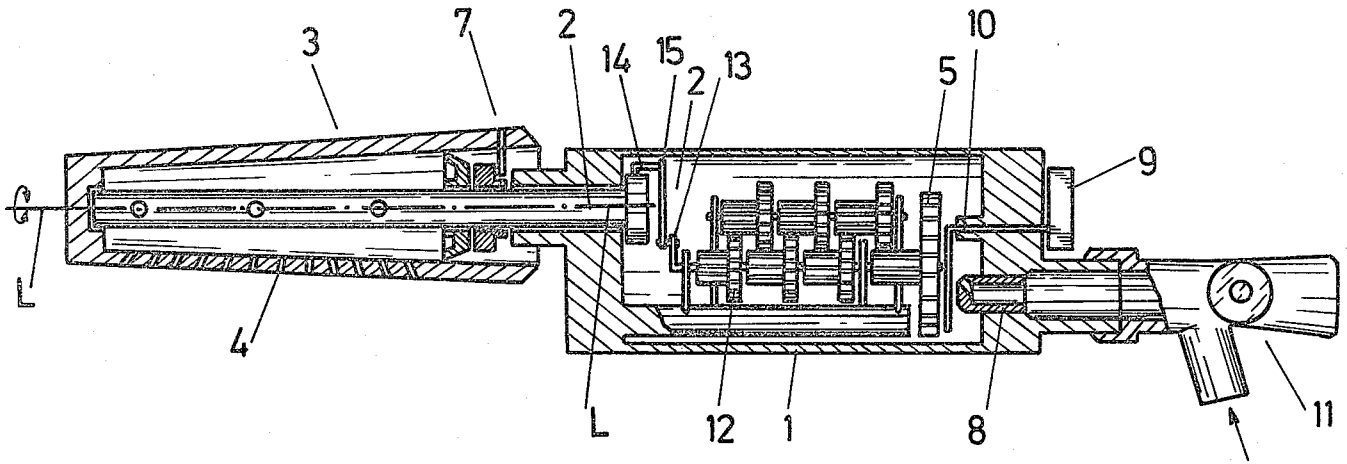
FIG. 1 shows a schematic, longitudinal, sectional view of a shower apparatus of the present invention comprising a shower head with broad-jet nozzles.
Figure 2:
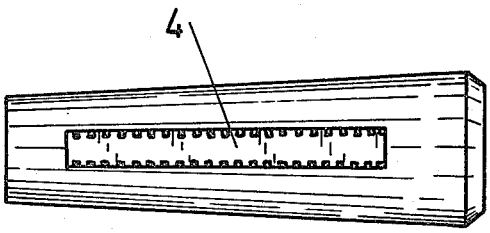
FIG. 2 shows the broad-jet nozzles.

The connecting pipe 2, which is mounted on one side, extends from the cylinder-shaped housing 1 into the shower head 3. The connecting pipe 2 is oscillated at an angle around its middle axle L—L in the housing. The broad-jet nozzles 4 are arranged in the shower head 3 which is turnable on the connecting pipe 2.

The turbine wheel 5 and the reducing gear 12 are mounted inside the housing 1, which also serves as a handle. The rotary force of the turbine wheel 5 via the reducing gear 12 is transformed into an oscillating movement by means of the eccentric means 13, 14 and 15.

Said oscillating movement is transmitted to the connecting pipe 2 carrying the shower head 3. The connecting pipe 2 oscillates as said around its longitudinal center axis L—L, preferably by an angle of between 50° and 80°. This means that the connecting pipe 2 makes alternately incomplete rotations. The shower head 3 is fastened to the connecting pipe 2 by means of the grooved eye screw 7, thereby being turnable around 360°, and is sealed by means of a collar.

A nozzle 8 is arranged at the entrance point of the water feed to the housing 1, said nozzle 8 directing the water jet onto the turbine wheel 5.

The speed of the oscillating movement is controlled by control means 9 with the deflecting plate 10, which is adapted to deflect the water jet from the turbine wheel 5 partially or completely, whereby in the latter case the water is exclusively fed to the nozzles.

By means of the holding device 11, which is a hinge member, the shower apparatus can be attached to a mandrel.

Figure 3:
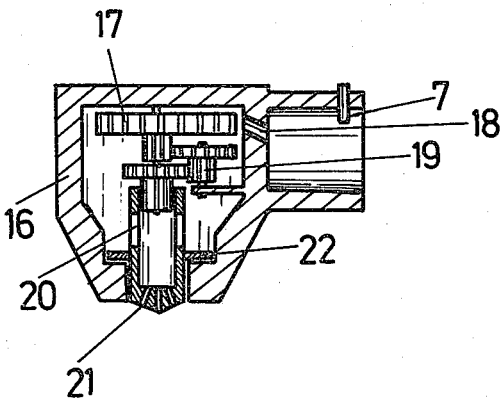
FIG. 3 shows the shower head with rotating nozzles.
Figure 4:
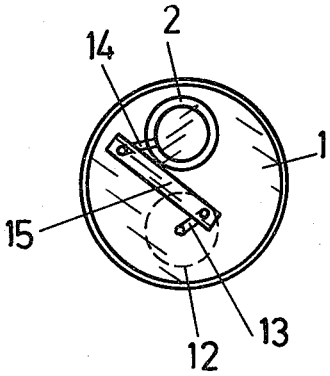
FIG. 4 shows a schematic view of the eccentric driving the connecting pipe.
Figure 5:
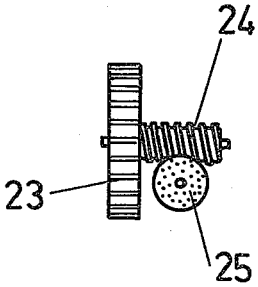
FIG. 5 shows a schematic view of a variant of the rotating nozzle driven by means of a worm gear.

The alternative embodiments comprising the rotating nozzle are shown in FIGS. 3 and 5.

The shower head 16 is fastened to the connecting pipe 2 in the same manner as the broad-jet shower head 3, whereby the connecting pipe 2 is preferably shorter.

The turbine wheel 17 is mounted in the housing 16, the inlet nozzle 18 for the water feed being directed towards said turbine wheel 17. The reducing gear 19 is subordinated to the turbine wheel 17, said reducing gear effecting the rotation of the rotating nozzle 20 by means of nozzle bores 21.

The water is through the nozzle 20 internally fed to the nozzle bores 21, which are conically directed to the outside. The collar 22 prevents the water from exiting between the rotating nozzle 20 and the housing 16.

As shown in FIG. 5, a worm gear 24 can be provided as a driving means from the turbine wheel 23 to the rotating nozzle 25.

The embodiment of the present invention comprising the rotating nozzles 20, 25 is a particularly attractive shower apparatus.

The oscillating shower apparatus can also be combined with prior art nozzles producing bubbling or pulsating water jets. These nozzles may alternatively be replaced by the shower heads 16 or 3.

What is claimed is:

1. A hand-held shower apparatus comprising a handle for said shower including an elongated housing connected to a water supply at one end and an elongated shower head mounted on the other end of said housing in longitudinal alinement therewith, wherein said shower head is carried by a connecting pipe oscillating about its axis in said housing and concentric with the shower head, wherein said connecting pipe oscillates by means of eccentric driving means.

2. A shower apparatus according to claim 1 wherein said shower head is provided with a slot-type nozzle producing broad water jets.

3. A shower apparatus according to claim 2, wherein said shower head is of longitudinal configuration.

4. A hand-held shower apparatus comprising a handle for said shower including a housing connected to a water supply at one end and an elongated shower head mounted on said housing at its other end in longitudinal alinement therewith, wherein said shower head is carried by a connecting pipe oscillating about its axis in said housing and concentric with said shower head, wherein a turbine wheel is arranged in said housing opposite the entrance point of the water, said turbine wheel being coupled with said connecting pipe by means of a reducing gear.

5. A shower apparatus according to claim 4, wherein a deflecting plate is arranged between the entrance point of the water in said housing and said turbine wheel for controlling the oscillating speed of said shower head, said deflecting plate being pivotable by means of a lever arranged on the outer side of said housing.

* * * * *